US009508338B1

(12) United States Patent
Kaszczuk et al.

(10) Patent No.: US 9,508,338 B1
(45) Date of Patent: Nov. 29, 2016

(54) INSERTING BREATH SOUNDS INTO TEXT-TO-SPEECH OUTPUT

(71) Applicant: Amazon Technologies, Inc., Reno, NV (US)

(72) Inventors: Michal Tadeusz Kaszczuk, Gdansk (PL); Maciej Tegi, Warsaw (PL); Michal Czuczman, Rumia (PL); Remus Razvan Mois, Sopot (PL)

(73) Assignee: Amazon Technologies, Inc., Seattle, WA (US)

( * ) Notice: Subject to any disclaimer, the term of this patent is extended or adjusted under 35 U.S.C. 154(b) by 330 days.

(21) Appl. No.: 14/081,233

(22) Filed: Nov. 15, 2013

(51) Int. Cl.
*G10L 13/08* (2013.01)
*G10L 13/02* (2013.01)

(52) U.S. Cl.
CPC ..... *G10L 13/02* (2013.01)

(58) Field of Classification Search
CPC ..... G10L 13/08
USPC ..... 704/266
See application file for complete search history.

(56) References Cited

U.S. PATENT DOCUMENTS 5,850,629 A * 12/1998 Holm ..... G06F 3/16 704/260
6,535,849 B1 * 3/2003 Pakhomov ..... G10L 15/063 704/235
2002/0156627 A1 * 10/2002 Itoh ..... G10L 15/187 704/254
2007/0233486 A1 * 10/2007 Griggs ..... G10L 15/26 704/251
2008/0071529 A1 * 3/2008 Silverman ..... G10L 13/02 704/220
2008/0167875 A1 * 7/2008 Bakis ..... G10L 13/08 704/258
2009/0006098 A1 * 1/2009 Nishiike ..... G10L 13/10 704/260
2009/0124272 A1 * 5/2009 White ..... G10L 15/30 455/466
2009/0254345 A1 * 10/2009 Fleizach ..... G10L 13/043 704/260
2010/0292989 A1 * 11/2010 Kitade ..... G10L 15/26 704/255
2014/0058734 A1 * 2/2014 Bakis ..... G10L 13/033 704/260

* cited by examiner

*Primary Examiner* — Michael N Opsasnick
(74) *Attorney, Agent, or Firm* — Seyfarth Shaw LLP; Ilan N. Barzilay

(57) ABSTRACT

A text-to-speech (TTS) system may be configured to incorporate breath sounds in the output speech. By incorporating breath sounds into speech output from text a TTS system may be able to mimic more naturally sounding human speech, particularly for long-form narration of text longer than short phrases. The breath sounds may be stored as units for unit selection or may be generated during parametric synthesis. The acoustic features of the breath sounds and duration between breaths may depend upon the punctuation of text, the linguistic distance between breaths, the breaks between intonational phrases, the linguistic context of the breaths, and other factors.

23 Claims, 9 Drawing Sheets

INSERTING BREATH SOUNDS INTO TEXT-TO-SPEECH OUTPUT

BACKGROUND

Human-computer interactions have progressed to the point where computing devices can render spoken language output to users based on textual sources available to the devices. In such text-to-speech (TTS) systems, a device converts text into an acoustic waveform that is recognizable as speech corresponding to the input text. TTS systems may provide spoken output to users in a number of applications, enabling a user to receive information from a device without necessarily having to rely on tradition visual output devices, such as a monitor or screen. A TTS process may be referred to as speech synthesis or speech generation.

Speech synthesis may be used by computers, hand-held devices, telephone computer systems, kiosks, automobiles, and a wide variety of other devices to improve human-computer interactions.

BRIEF DESCRIPTION OF DRAWINGS

For a more complete understanding of the present disclosure, reference is now made to the following description taken in conjunction with the accompanying drawings.

DETAILED DESCRIPTION

Existing text-to-speech (TTS) processing break up output speech using silent pauses. Natural human speech, however, frequently includes audible breathing sounds as a speaker inhales or exhales during normal speaking Existing TTS systems do not include such breathing sounds in TTS output, resulting in synthesized speech that does not sound as natural as it could. Offered is a system for including breath sounds in TTS output.

Figure 1A:
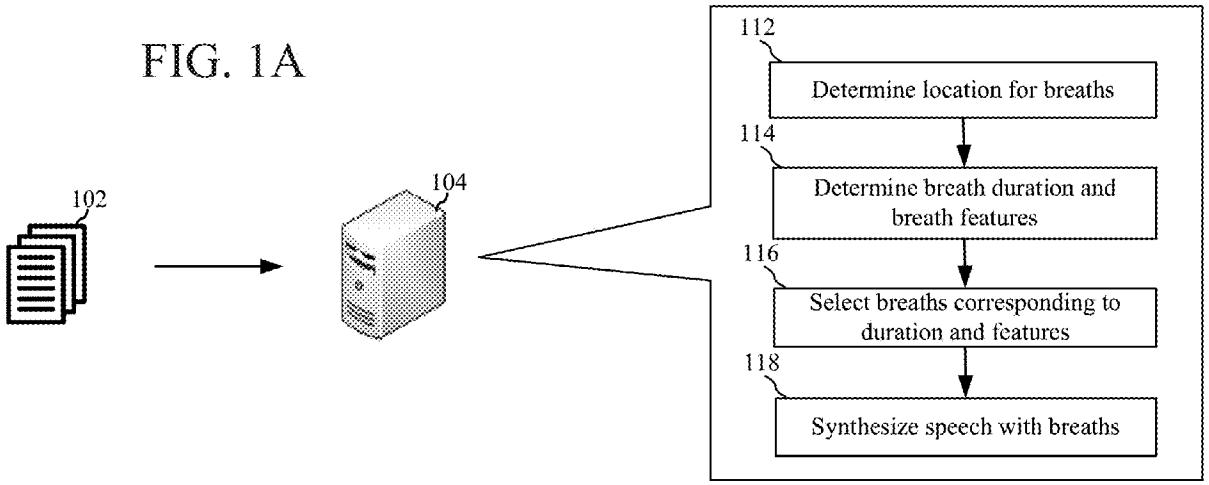
FIGS. 1A-1B illustrates generating speech with breath sounds according to one aspect of the present disclosure.

During system configuration, a TTS system analyzes the breaths that occur in the audio samples that make up the training corpus. Those breaths are incorporated as phonetic units which may be reproduced and incorporated into output synthesized speech. As shown in FIG. 1A, a TTS device 104 receives input text 102. Based on the input text 102, the TTS device 104 determines a location for breaths to be inserted in the output speech, as shown in block 112. The TTS device 104 then determines the duration and acoustic features of the particular breath sounds to be inserted in the determined locations, as shown in block 114. The TTS device 104 then selects breath sounds corresponding to the determined duration and acoustic features, as shown in block 116. The TTS device 104 then synthesizes speech with the particular breaths in their appropriate locations, as shown in block 118.

Figure 1B:
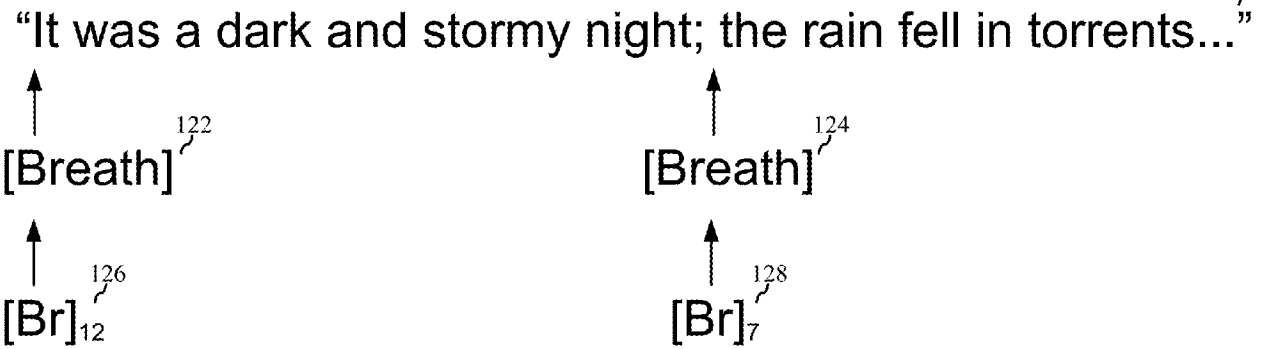

As an example, FIG. 1B shows a portion of input text 120, which includes the famous opening text of the novel *Paul Clifford* by Edward Bulwer-Lytton. The TTS device 104 may determine (based on the text, the surrounding phonemes, and other factors discussed below) that a breath 122 should be located at the beginning of the text and that another breath 124 should be located after the semicolon. The TTS device 104 then determines what the specific breaths should sound like in those locations. For purposes of illustration, if the TTS device 104 has twenty different breath sounds to choose from, it determines that breath number 12, represented in the figure as $[Br]_{12}$ 126, should be inserted in the first breath location 122 and breath number 7, represented in the figure as $[Br]_{7}$ 128, should be inserted in the second breath location 124. The TTS device will then synthesize speech for output, with the speech including the specified breath sounds at the specified locations, in between the synthesized speech of the text. Further details of the method and system for performing this speech synthesis are described below.

Figure 2:
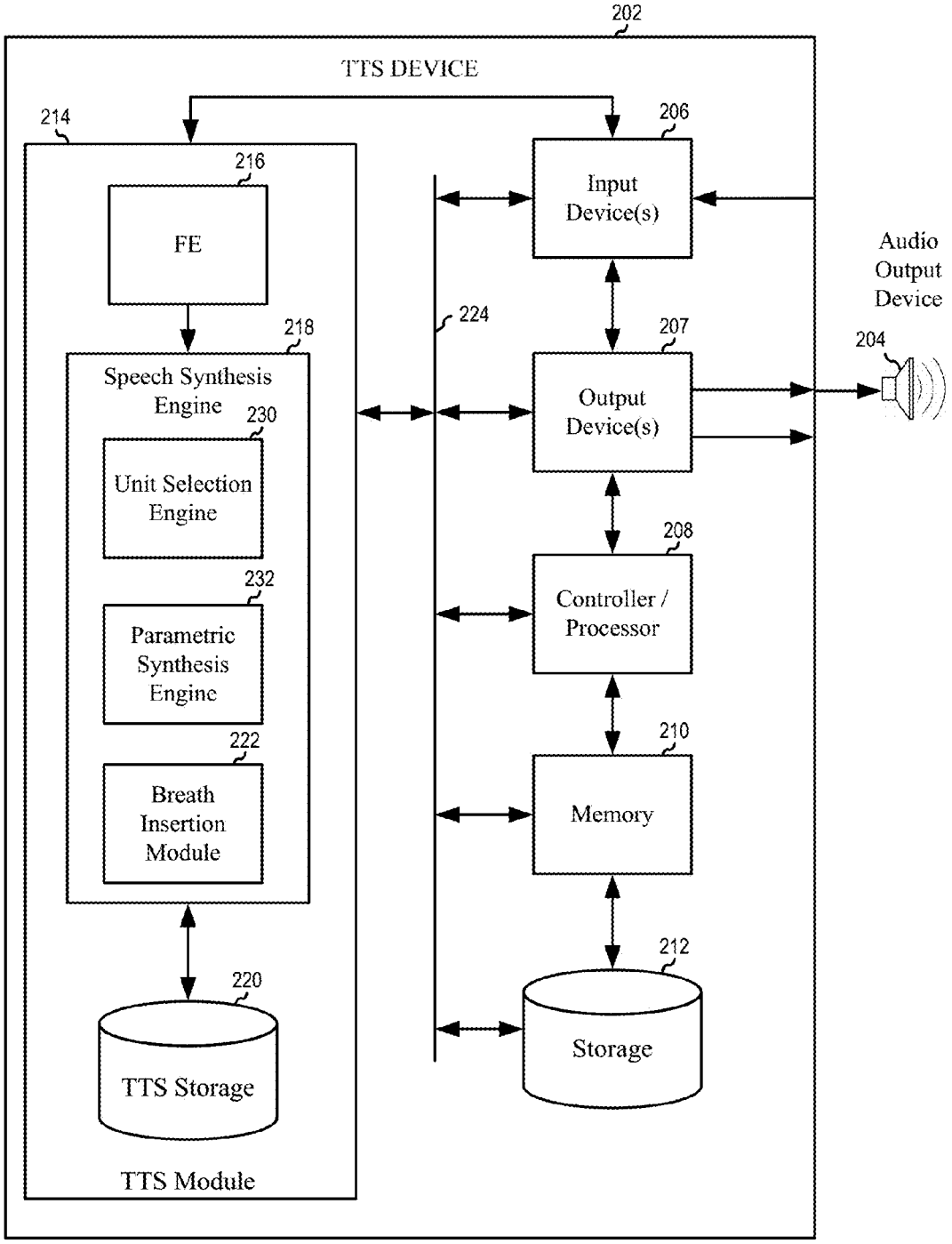
FIG. 2 is a block diagram conceptually illustrating a device for text-to-speech processing according to one aspect of the present disclosure.

FIG. 2 shows a text-to-speech (TTS) device 202 for performing speech synthesis. Aspects of the present disclosure include computer-readable and computer-executable instructions that may reside on the TTS device 202. FIG. 2 illustrates a number of components that may be included in the TTS device 202, however other non-illustrated components may also be included. Also, some of the illustrated components may not be present in every device capable of employing aspects of the present disclosure. Further, some components that are illustrated in the TTS device 202 as a single component may also appear multiple times in a single device. For example, the TTS device 202 may include multiple input devices 206, output devices 207 or multiple controllers/processors 208.

Multiple TTS devices may be employed in a single speech synthesis system. In such a multi-device system, the TTS devices may include different components for performing different aspects of the speech synthesis process. The multiple devices may include overlapping components. The TTS device as illustrated in FIG. 2 is exemplary, and may be a stand-alone device or may be included, in whole or in part, as a component of a larger device or system.

The teachings of the present disclosure may be applied within a number of different devices and computer systems, including, for example, general-purpose computing systems, server-client computing systems, mainframe computing systems, telephone computing systems, laptop computers, cellular phones, personal digital assistants (PDAs), tablet computers, other mobile devices, etc. The TTS device 202 may also be a component of other devices or systems that may provide speech recognition functionality such as automated teller machines (ATMs), kiosks, global position systems (GPS), home appliances (such as refrigerators, ovens, etc.), vehicles (such as cars, buses, motorcycles, etc.), and/or ebook readers, for example.

As illustrated in FIG. 2, the TTS device 202 may include an audio output device 204 for outputting speech processed by the TTS device 202 or by another device. The audio output device 204 may include a speaker, headphone, or other suitable component to propagate sound. The audio output device 204 may be integrated into the TTS device 202 or may be separate from the TTS device 202. The TTS device 202 may also include an address/data bus 224 for conveying data among components of the TTS device 202. Each component within the TTS device 202 may also be directly connected to other components in addition to (or instead of) being connected to other components across the bus 224. Although certain components are illustrated in FIG. 2 as directly connected, these connections are illustrative only and other components may be directly connected to each other (such as the TTS module 214 to the controller/processor 208).

The TTS device 202 may include a controller/processor 208 that may be a central processing unit (CPU) for processing data and computer-readable instructions and a memory 210 for storing data and instructions. The memory 210 may include volatile random access memory (RAM), non-volatile read only memory (ROM), and/or other types of memory. The TTS device 202 may also include a data storage component 212, for storing data and instructions. The data storage component 212 may include one or more storage types such as magnetic storage, optical storage, solid-state storage, etc. The TTS device 202 may also be connected to removable or external memory and/or storage (such as a removable memory card, memory key drive, networked storage, etc.) through the input device 206 or output device 207. Computer instructions for processing by the controller/processor 208 for operating the TTS device 202 and its various components may be executed by the controller/processor 208 and stored in the memory 210, storage 212, external device, or in memory/storage included in the TTS module 214 discussed below. Alternatively, some or all of the executable instructions may be embedded in hardware or firmware in addition to or instead of software. The teachings of this disclosure may be implemented in various combinations of software, firmware, and/or hardware, for example.

The TTS device 202 includes input device(s) 206 and output device(s) 207. A variety of input/output device(s) may be included in the device. Example input devices include an audio output device 204, such as a microphone, a touch input device, keyboard, mouse, stylus or other input device. Example output devices include a visual display, tactile display, audio speakers (pictured as a separate component), headphones, printer or other output device. The input device(s) 206 and/or output device(s) 207 may also include an interface for an external peripheral device connection such as universal serial bus (USB), FireWire, Thunderbolt or other connection protocol. The input device(s) 206 and/or output device(s) 207 may also include a network connection such as an Ethernet port, modem, etc. The input device(s) 206 and/or output device(s) 207 may also include a wireless communication device, such as radio frequency (RF), infrared, Bluetooth, wireless local area network (WLAN) (such as WiFi), or wireless network radio, such as a radio capable of communication with a wireless communication network such as a Long Term Evolution (LTE) network, WiMAX network, 3G network, etc. Through the input device(s) 206 and/or output device(s) 207 the TTS device 202 may connect to a network, such as the Internet or private network, which may include a distributed computing environment.

The device may also include an TTS module 214 for processing textual data into audio waveforms including speech. The TTS module 214 may be connected to the bus 224, input device(s) 206, output device(s) 207, audio output device 204, controller/processor 208 and/or other component of the TTS device 202. The textual data may originate from an internal component of the TTS device 202 or may be received by the TTS device 202 from an input device such as a keyboard or may be sent to the TTS device 202 over a network connection. The text may be in the form of sentences including text, numbers, and/or punctuation for conversion by the TTS module 214 into speech. The input text may also include special annotations for processing by the TTS module 214 to indicate how particular text is to be pronounced when spoken aloud. Textual data may be processed in real time or may be saved and processed at a later time.

The TTS module 214 includes a TTS front end (FE) 216, a speech synthesis engine 218, and TTS storage 220. The FE 216 transforms input text data into a symbolic linguistic representation for processing by the speech synthesis engine 218. The speech synthesis engine 218 compares the annotated phonetic units models and information stored in the TTS storage 220 for converting the input text into speech. The FE 216 and speech synthesis engine 218 may include their own controller(s)/processor(s) and memory or they may use the controller/processor 208 and memory 210 of the TTS device 202, for example. Similarly, the instructions for operating the FE 216 and speech synthesis engine 218 may be located within the TTS module 214, within the memory 210 and/or storage 212 of the TTS device 202, or within an external device.

Text input into a TTS module 214 may be sent to the FE 216 for processing. The front-end may include modules for performing text normalization, linguistic analysis, and linguistic prosody generation. During text normalization, the FE processes the text input and generates standard text, converting such things as numbers, abbreviations (such as Apt., St., etc.), symbols ($, %, etc.) into the equivalent of written out words.

During linguistic analysis the FE 216 analyzes the language in the normalized text to generate a sequence of phonetic units corresponding to the input text. This process may be referred to as phonetic transcription. Phonetic units include symbolic representations of sound units to be eventually combined and output by the TTS device 202 as speech. Various sound units may be used for dividing text for purposes of speech synthesis. A TTS module 214 may process speech based on phonemes (individual sounds), half-phonemes, di-phones (the last half of one phoneme coupled with the first half of the adjacent phoneme), bi-phones (two consecutive phonemes), syllables, words, phrases, sentences, or other units. Each word may be mapped to one or more phonetic units. Such mapping may be performed using a language dictionary stored in the TTS device 202, for example in the TTS storage module 220. The linguistic analysis performed by the FE 216 may also identify different grammatical components such as prefixes, suffixes, phrases, punctuation, syntactic boundaries, or the like. Such grammatical components may be used by the TTS module 214 to craft a natural sounding audio waveform output. The language dictionary may also include letter-to-sound rules and other tools that may be used to pronounce previously unidentified words or letter combinations that may be encountered by the TTS module 214. Generally, the more information included in the language dictionary, the higher quality the speech output.

Based on the linguistic analysis the FE 216 may then perform linguistic prosody generation where the phonetic units are annotated with desired prosodic characteristics, also called acoustic features, which indicate how the desired phonetic units are to be pronounced in the eventual output speech. During this stage the FE 216 may consider and incorporate any prosodic annotations that accompanied the text input to the TTS module 214. Such acoustic features may include pitch, energy, duration, and the like. Application of acoustic features may be based on prosodic models available to the TTS module 214. Such prosodic models indicate how specific phonetic units are to be pronounced in certain circumstances. A prosodic model may consider, for example, a phoneme's position in a syllable, a syllable's position in a word, a word's position in a sentence or phrase, neighboring phonetic units, etc. As with the language dictionary, prosodic model with more information may result in higher quality speech output than prosodic models with less information.

The output of the FE 216, referred to as a symbolic linguistic representation, may include a sequence of phonetic units annotated with prosodic characteristics. This symbolic linguistic representation may be sent to a speech synthesis engine 218, also known as a synthesizer, for conversion into an audio waveform of speech for output to an audio output device 204 and eventually to a user. The speech synthesis engine 218 may be configured to convert the input text into high-quality natural-sounding speech in an efficient manner. Such high-quality speech may be configured to sound as much like a human speaker as possible, or may be configured to be understandable to a listener without attempts to mimic a precise human voice.

A speech synthesis engine 218 may perform speech synthesis using one or more different methods. In one method of synthesis called unit selection, described further below, a unit selection engine 230 matches a database of recorded speech against the symbolic linguistic representation created by the FE 216. The unit selection engine 230 matches the symbolic linguistic representation against spoken audio units in the database. Matching units are selected and concatenated together to form a speech output. Each unit includes an audio waveform corresponding with a phonetic unit, such as a short .wav file of the specific sound, along with a description of the various acoustic features associated with the .wav file (such as its pitch, energy, etc.), as well as other information, such as where the phonetic unit appears in a word, sentence, or phrase, the neighboring phonetic units, etc. Using all the information in the unit database, a unit selection engine 230 may match units to the input text to create a natural sounding waveform. The unit database may include multiple examples of phonetic units to provide the TTS device 202 with many different options for concatenating units into speech. One benefit of unit selection is that, depending on the size of the database, a natural sounding speech output may be generated. The larger the unit database, the more likely the TTS device 202 will be able to construct natural sounding speech.

In another method of synthesis called parametric synthesis parameters such as frequency, volume, noise, are varied by a parametric synthesis engine 232, digital signal processor or other audio generation device to create an artificial speech waveform output. Parametric synthesis may use an acoustic model and various statistical techniques to match a symbolic linguistic representation with desired output speech parameters. Parametric synthesis may include the ability to be accurate at high processing speeds, as well as the ability to process speech without large databases associated with unit selection, but also typically produces an output speech quality that may not match that of unit selection. Unit selection and parametric techniques may be performed individually or combined together and/or combined with other synthesis techniques to produce speech audio output.

Parametric speech synthesis may be performed as follows. A TTS module 214 may include an acoustic model, or other models, which may convert a symbolic linguistic representation into a synthetic acoustic waveform of the text input based on audio signal manipulation. The acoustic model includes rules which may be used by the parametric synthesis engine 232 to assign specific audio waveform parameters to input phonetic units and/or prosodic annotations. The rules may be used to calculate a score representing a likelihood that a particular audio output parameter(s) (such as frequency, volume, etc.) corresponds to the portion of the input symbolic linguistic representation from the FE 216.

The parametric synthesis engine 232 may use a number of techniques to match speech to be synthesized with input phonetic units and/or prosodic annotations. One common technique is using Hidden Markov Models (HMMs). HMMs may be used to determine probabilities that audio output should match textual input. HMMs may be used to translate from parameters from the linguistic and acoustic space to the parameters to be used by a vocoder (a digital voice encoder) to artificially synthesize the desired speech. Using HMMs, a number of states are presented, in which the states together represent one or more potential acoustic parameters to be output to the vocoder and each state is associated with a model, such as a Gaussian mixture model. Transitions between states may also have an associated probability, representing a likelihood that a current state may be reached from a previous state. Sounds to be output may be represented as paths between states of the HMM and multiple paths may represent multiple possible audio matches for the same input text. Each portion of text may be represented by multiple potential states corresponding to different known pronunciations of phonemes and their parts (such as the phoneme identity, stress, accent, position, etc.). An initial determination of a probability of a potential phoneme may be associated with one state. As new text is processed by the speech synthesis engine 218, the state may change or stay the same, based on the processing of the new text. For example, the pronunciation of a previously processed word might change based on later processed words. A Viterbi algorithm may be used to find the most likely sequence of states based on the processed text. The HMMs may generate speech in parametrized form including parameters such as fundamental frequency (f0), noise envelope, spectral envelope, etc. that are translated by a vocoder into audio segments. The output parameters may be configured for particular vocoders such as a STRAIGHT vocoder, TANDEM-STRAIGHT vocoder, HNM (harmonic plus noise) based vocoders, CELP (code-excited linear prediction) vocoders, GlottHMM vocoders, HSM (harmonic/stochastic model) vocoders, or others.

Figure 3:
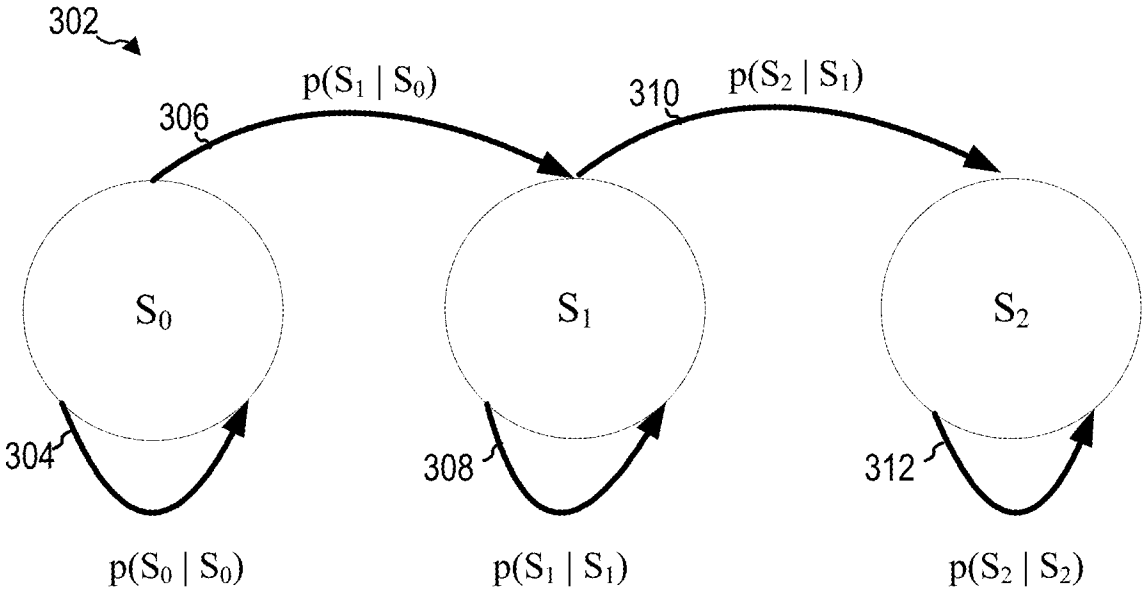
FIG. 3 illustrates speech synthesis using a Hidden Markov Model according to one aspect of the present disclosure.

An example of HMM processing for speech synthesis is shown in FIG. 3. A sample input phonetic unit, for example, phoneme /E/, may be processed by a parametric synthesis engine 232. The parametric synthesis engine 232 may initially assign a probability that the proper audio output associated with that phoneme is represented by state $S_0$ in the Hidden Markov Model illustrated in FIG. 3. After further processing, the speech synthesis engine 218 determines whether the state should either remain the same, or change to a new state. For example, whether the state should remain the same 304 may depend on the corresponding transition probability (written as $P(S_0|S_0)$, meaning the probability of going from state $S_0$ to $S_0$) and how well the subsequent frame matches states $S_0$ and $S_1$. If state $S_1$ is the most probable, the calculations move to state $S_1$ and continue from there. For subsequent phonetic units, the speech synthesis engine 218 similarly determines whether the state should remain at $S_1$, using the transition probability represented by $P(S_1|S_1)$ 308, or move to the next state, using the transition probability $P(S_2|S_1)$ 310. As the processing continues, the parametric synthesis engine 232 continues calculating such probabilities including the probability 312 of remaining in state $S_2$ or the probability of moving from a state of illustrated phoneme /E/ to a state of another phoneme. After processing the phonetic units and acoustic features for state $S_2$, the speech recognition may move to the next phonetic unit in the input text.

The probabilities and states may be calculated using a number of techniques. For example, probabilities for each state may be calculated using a Gaussian model, Gaussian mixture model, or other technique based on the feature vectors and the contents of the TTS storage 220. Techniques such as maximum likelihood estimation (MLE) may be used to estimate the probability of particular states.

In addition to calculating potential states for one audio waveform as a potential match to a phonetic unit, the parametric synthesis engine 232 may also calculate potential states for other potential audio outputs (such as various ways of pronouncing phoneme /E/) as potential acoustic matches for the phonetic unit. In this manner multiple states and state transition probabilities may be calculated.

The probable states and probable state transitions calculated by the parametric synthesis engine 232 may lead to a number of potential audio output sequences. Based on the acoustic model and other potential models, the potential audio output sequences may be scored according to a confidence level of the parametric synthesis engine 232. The highest scoring audio output sequence, including a stream of parameters to be synthesized, may be chosen and digital signal processing may be performed by a vocoder or similar component to create an audio output including synthesized speech waveforms corresponding to the parameters of the highest scoring audio output sequence and, if the proper sequence was selected, also corresponding to the input text.

Unit selection speech synthesis may be performed as follows. Unit selection includes a two-step process. First a unit selection engine 230 determines what speech units to use and then it combines them so that the particular combined units match the desired phonemes and acoustic features and create the desired speech output. Units may be selected based on a cost function which represents how well particular units fit the speech segments to be synthesized. The cost function may represent a combination of different costs representing different aspects of how well a particular speech unit may work for a particular speech segment. For example, a target cost indicates how well a given speech unit matches the features of a desired speech output (e.g., pitch, prosody, etc.). A join cost represents how well a speech unit matches a consecutive speech unit for purposes of concatenating the speech units together in the eventual synthesized speech. The overall cost function is a combination of target cost, join cost, and other costs that may be determined by the unit selection engine 230. As part of unit selection, the unit selection engine 230 chooses the speech unit with the lowest overall combined cost. For example, a speech unit with a very low target cost may not necessarily be selected if its join cost is high.

A TTS device 202 may be configured with a speech unit database for use in unit selection. The speech unit database may be stored in TTS storage 220, in storage 212, or in another storage component. The speech unit database includes recorded speech utterances with the utterances' corresponding text aligned to the utterances. The speech unit database may include many hours of recorded speech (in the form of audio waveforms, feature vectors, or other formats), which may occupy a significant amount of storage in the TTS device 202. The unit samples in the speech unit database may be classified in a variety of ways including by phonetic unit (phoneme, diphone, word, etc.), linguistic prosodic label, acoustic feature sequence, speaker identity, etc. The sample utterances may be used to create mathematical models corresponding to desired audio output for particular speech units. When matching a symbolic linguistic representation the speech synthesis engine 218 may attempt to select a unit in the speech unit database that most closely matches the input text (including both phonetic units and prosodic annotations). Generally the larger the speech unit database the better the speech synthesis may be achieved by virtue of the greater number of unit samples that may be selected to form the precise desired speech output.

Figure 4A:
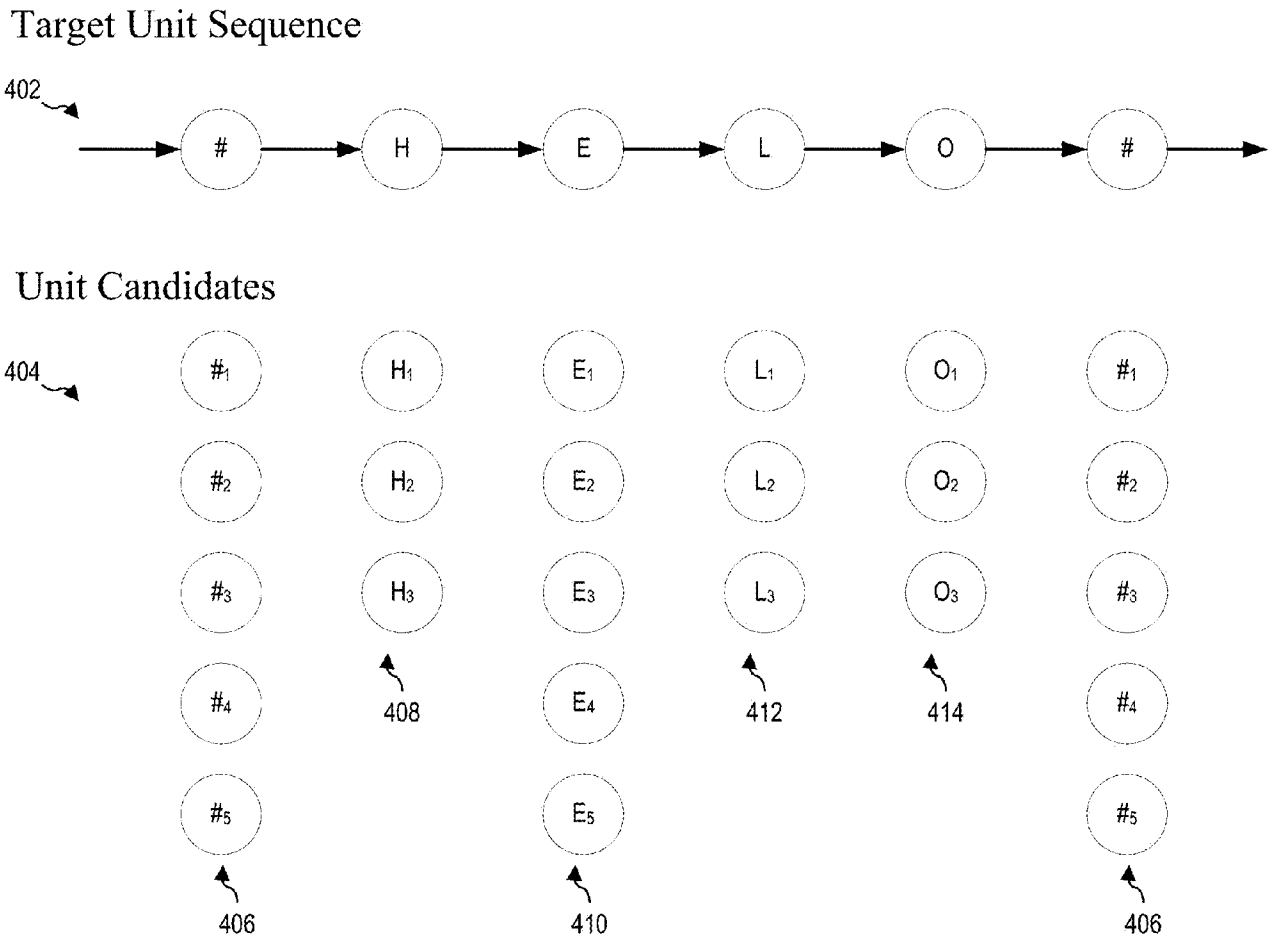
FIGS. 4A-4B illustrate speech synthesis using unit selection according to one aspect of the present disclosure.
Figure 4B:
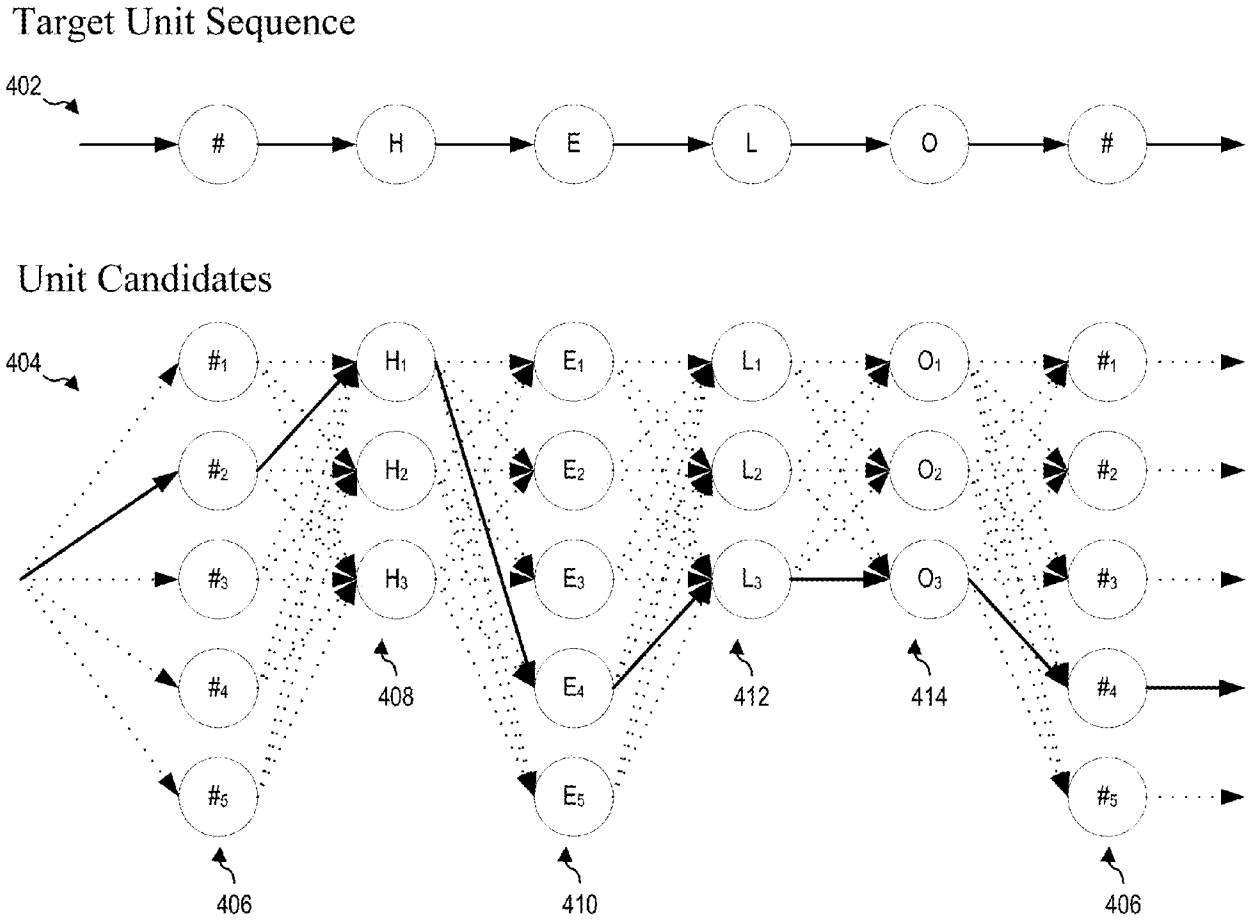

For example, as shown in FIG. 4A, a target sequence of phonetic units 402 to synthesize the word "hello" is determined by the unit selection engine 230. A number of candidate units 404 may be stored in the TTS storage 220. Although phonemes are illustrated in FIG. 4A, other phonetic units, such as diphones, may be selected and used for unit selection speech synthesis. For each phonetic unit there are a number of potential candidate units (represented by columns 406, 408, 410, 412 and 414) available. Each candidate unit represents a particular recording of the phonetic unit with a particular associated set of acoustic features. The unit selection engine 230 then creates a graph of potential sequences of candidate units to synthesize the available speech. The size of this graph may be variable based on certain device settings. An example of this graph is shown in FIG. 4B. A number of potential paths through the graph are illustrated by the different dotted lines connecting the candidate units. A Viterbi algorithm may be used to determine potential paths through the graph. Each path may be given a score incorporating both how well the candidate units match the target units (with a high score representing a low target cost of the candidate units) and how well the candidate units concatenate together in an eventual synthesized sequence (with a high score representing a low join cost of those respective candidate units). The unit selection engine 230 may select the sequence that has the lowest overall cost (represented by a combination of target costs and join costs) or may choose a sequence based on customized functions for target cost, join cost or other factors. The candidate units along the selected path through the graph may then be combined together to form an output audio waveform representing the speech of the input text. For example, in FIG. 4B the selected path is represented by the solid line. Thus units $\#_2$, $H_1$, $E_4$, $L_3$, $O_3$, and $\#_4$ may be selected to synthesize audio for the word "hello."

Audio waveforms including the speech output from the TTS module 214 may be sent to an audio output device 204 for playback to a user or may be sent to the output device 207 for transmission to another device, such as another TTS device 202, for further processing or output to a user. Audio waveforms including the speech may be sent in a number of different formats such as a series of feature vectors, uncompressed audio data, or compressed audio data. For example, audio speech output may be encoded and/or compressed by an encoder/decoder (not shown) prior to transmission. The encoder/decoder may be customized for encoding and decoding speech data, such as digitized audio data, feature vectors, etc. The encoder/decoder may also encode non-TTS data of the TTS device 202, for example using a general encoding scheme such as .zip, etc. The functionality of the encoder/decoder may be located in a separate component or may be executed by the controller/processor 208, TTS module 214, or other component, for example.

Other information may also be stored in the TTS storage 220 for use in speech recognition. The contents of the TTS storage 220 may be prepared for general TTS use or may be customized to include sounds and words that are likely to be used in a particular application. For example, for TTS processing by a global positioning system (GPS) device, the TTS storage 220 may include customized speech specific to location and navigation. In certain instances the TTS storage 220 may be customized for an individual user based on his/her individualized desired speech output. For example a user may prefer a speech output voice to be a specific gender, have a specific accent, speak at a specific speed/rate, have a distinct emotive quality (e.g., a happy voice), or other customizable characteristic. The speech synthesis engine 218 may include specialized databases or models to account for such user preferences. A TTS device 202 may also be configured to perform TTS processing in multiple languages. For each language, the TTS module 214 may include specially configured data, instructions and/or components to synthesize speech in the desired language(s). To improve performance, the TTS module 214 may revise/update the contents of the TTS storage 220 based on feedback of the results of TTS processing, thus enabling the TTS module 214 to improve speech recognition beyond the capabilities provided in the training corpus.

Figure 5:
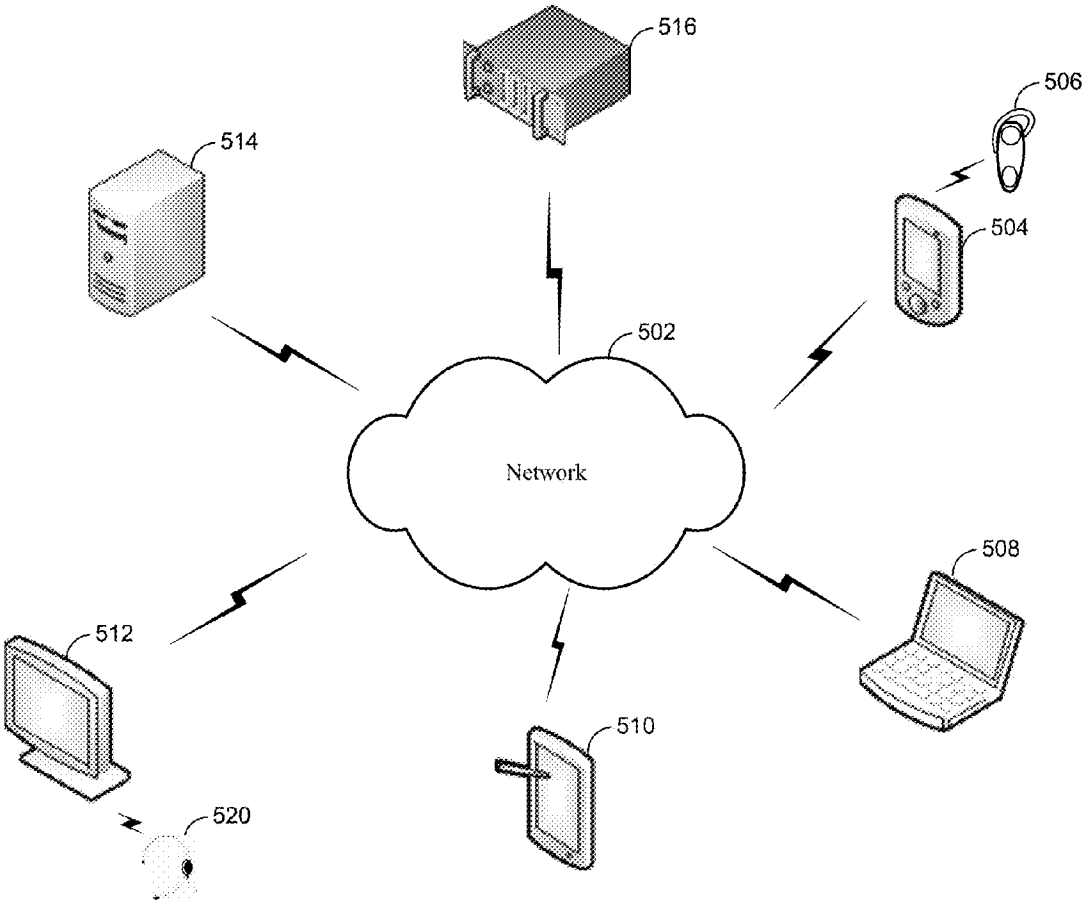
FIG. 5 illustrates a computer network for use with text-to-speech processing according to one aspect of the present disclosure.

Multiple TTS devices 202 may be connected over a network. As shown in FIG. 5 multiple devices may be connected over network 502. Network 502 may include a local or private network or may include a wide network such as the internet. Devices may be connected to the network 502 through either wired or wireless connections. For example, a wireless device 504 may be connected to the network 502 through a wireless service provider. Other devices, such as computer 512, may connect to the network 502 through a wired connection. Other devices, such as laptop 508 or tablet computer 510 may be capable of connection to the network 502 using various connection methods including through a wireless service provider, over a WiFi connection, or the like. Networked devices may output synthesized speech through a number of audio output devices including through headsets 506 or 520. Audio output devices may be connected to networked devices either through a wired or wireless connection. Networked devices may also include embedded audio output devices, such as an internal speaker in laptop 508, wireless device 504 or table computer 510.

In certain TTS system configurations, a combination of devices may be used. For example, one device may receive text, another device may process text into speech, and still another device may output the speech to a user. For example, text may be received by a wireless device 504 and sent to a computer 514 or server 516 for TTS processing. The resulting speech audio data may be returned to the wireless device 504 for output through headset 506. Or computer 512 may partially process the text before sending it over the network 502. Because TTS processing may involve significant computational resources, in terms of both storage and processing power, such split configurations may be employed where the device receiving the text/outputting the processed speech may have lower processing capabilities than a remote device and higher quality TTS results are desired. The TTS processing may thus occur remotely with the synthesized speech results sent to another device for playback near a user.

Traditional TTS processing is typically suited for converting small segments of text to speech, such as short sentences or brief statements. Examples of such short sentences include voice prompts from an automated telephone agent, audible outputs from a speech enabled kiosk, and the like. Traditional TTS is less well suited to creating speech from longer text samples, such as paragraphs, books, etc. Converting such long text into speech, called long form narration, suffers from a number of drawbacks with existing TTS systems. Those drawbacks lead to creation of speech that may sound unnatural to a human listener.

Offered is a solution to make speech results sound more natural. Specifically, the present disclosure is directed to inserted breath sounds, which mimic the sound of natural inhalation and/or exhalation into TTS speech results. Breathing sounds (particularly inhalation sounds, as exhalation typically occurs while speaking) are a natural occurrence in human speech but are not incorporated into current TTS systems. The lack of respiratory sounds, particularly for long form narration, results in speech that may be perceived by a human listener as slightly unnatural. Human listeners may take breath sounds as unconscious cues on how to process the speech, such as rapid breathing indicating more urgency to the speech while slower breathing indicating, and inducing, calm in the listener. Insertion of breath sounds may more accurately assist in conveying punctuation, breaks between intonational phrases (discussed below), etc. Present TTS systems do not insert breath sounds but rather simply insert pauses between words or phrases of speech. While such silent breaks may be sufficient when producing shorter segments of speech results, the insertion of breath sounds will result in more natural sounding speech, particularly for long-form narration.

To incorporate breath sounds into a TTS system the TTS system may be configured to understand breath sounds as an independent phoneme to be synthesized as part of a phonetic unit (such as a half-phonemes, diphones, biphones, etc.) during TTS processing. During training of a TTS system, such as during the creation and configuration of a training corpus, breathing sounds in the voice samples which make up the training corpus may be analyzed. As the voice samples of a training corpus may come from a human voice actor, the breaths of the voice samples may incorporate natural sounding breath effects that the TTS system may analyze and reproduce when performing TTS processing. Various factors of the breath sounds in the training corpus may be catalogued, such as each breath sound's acoustic features (e.g., pitch, energy, duration, and the like). The acoustic features may also incorporate whether a breath is voiced (depending on whether the glottis vibrates during the breath), whether a breath is rising or falling, and other features. The audio segments of each breath sound may be stored as separate units in a unit database and associated with the respective breath sound's acoustic features. In this manner, each different breath sound will be represented by its own unit in the unit database. Thus the unit database will have long breaths, short breaths, heavy breaths, staccato breaths, or whatever kinds of breaths exist in the training corpus, available as units to use during unit selection. Similarly, if the TTS system incorporates parametric synthesis, parameters associated with the acoustic features of various available breath examples may be used to synthesize individual breaths for insertion into text.

As with other phonetic units, breath sounds will depend upon the training corpus of the system, and may depend on the voice actor used to develop the training corpus. Certain training corpus' may further be domain specific, that is may include language directed at a certain subject matter. Thus the available breath sounds may be dependent on the voice talent and/or the domain of the training corpus. To expand the variety of breath sounds available, a system may incorporate breath sounds from other training corpus examples using different voice actors and/or different domains to supplement the system's available breath variety.

In addition to incorporating the acoustic features of breath sounds, the TTS system may analyze the relationship of individual breath sounds to the speech in which they are located. Thus, the TTS system may note that for breaths of a particular duration (called a breath duration), a certain amount of speech typically follows, while for breaths of different breath duration a different amount of speech typically follows. For example, when a human takes a deep breath, he/she may speak longer than if he/she takes a shallow breath. If, in the training corpus, breaths of longer breath duration precede longer segments of speech than breaths of shorter breath duration, that factor may be noted by and incorporated into the TTS system. The TTS system may also note how much time it takes between certain breath sounds and neighboring spoken phonemes (for both phonemes that precede the breath or follow the breath). The TTS system may also note whether certain breaths are typically associated with being at either end of a particular breath interval, where a breath interval is a time period between breaths. For example, if a breath interval is particularly long, the breath at the beginning of the interval may sound like a deep breath and/or the breath at the end of the interval may sound like a breath of a speaker gasping for air after expending his/her lung capacity. Other factors relating breath to speech may also be noted by the TTS system.

For example, if a particular breath sound usually precedes a specific phoneme type (such as a vowel sound, a consonant sound, an open mouthed sound, etc.) the link between the breath sound and specific spoken phoneme may be noted by the TTS system. In another example, if a specific long duration breath sound is followed by a short segment of speech, then a short duration breath sound and then a long segment of speech, that phenomenon (or whatever applicable permutation) may be noted by the TTS system. In another example, if a voiced breath is typically preceded by or followed by a voiced spoken phoneme (or some other relationship exists between voiced or unvoiced breaths and phonemes), that may be noted by the TTS system. In another example, if some acoustic feature of a breath is typically associated with some acoustic feature of a neighboring spoken phoneme, that may be noted by the TTS system.

The TTS system may also train on, and then synthesize, differing speaking rates, which may in turn impact the location and selection of breath sounds. Faster speaking rates may call for shorter duration breath sounds, which may match the speed of each individual breath with the speaking rate. Similarly, slower speaking rates may call for longer breath sounds, to draw out the breath in the same manner as the speech. The speaking rate may also influence the placement of breath sounds, as a faster speaking rate may call for differently spaced breath sounds than a slower speaking rate. The speaking rate may be modeled by the TTS system, and/or may be controlled by users of the TTS system to make the speech faster or slower. The TTS system may be configured to match the placement and selection of breath sounds based in part on the speaking rate.

Depending on its processing capability, the TTS system may also note other relationships between breath and speech, such as any tendency for certain breath sounds to be near certain punctuation marks, any tendency for certain types of breath to be near certain types of speech segments (i.e. questions, declarations, descriptive clauses, the beginnings of sentences or paragraphs, etc.), and the like.

The various factors discussed above, as well as other factors, may be incorporated by the TTS system when it builds the model(s) to be incorporated into the TTS modules which actually perform TTS processing. Based on the model (s), and the various factors, TTS devices may insert breath sounds into speech as described below.

To insert breath sounds in output speech, a TTS device may include a breath module 222. The breath module 222 may be incorporated into the TTS module 214 (such as part of the FE 216, speech synthesis engine 218, or otherwise). Similarly, the functionality of the breath module 222 may be spread out among multiple components in the TTS module 214 or device 202. The breath module 222 may include components such as software, hardware, etc. to determine where in output speech to locate a breath and to determine what breath sound to place in the determined location. These determinations may be made separately, as part of a single process, or as part of other TTS processing. For purposes of illustration, however, they are described separately.

Breath location may be determined in a manner similar to determining the location of pauses in speech output. This may occur following linguistic analysis/phonetic transcription as performed by the FE 216. As the phonetic transcription determines how the input text is likely to be pronounced, determining breath sounds may occur after phonetic transcription. The TTS device may determine appropriate locations in the input text to locate breath sounds. Breath sounds may be located near the start of speech, following certain kinds of punctuation, at breaks between intonational phrases, or at other locations. An intonational phrase is a portion of speech (or associated text) that has its own intonational pattern. An intonational phrase may have one or more accent points. Boundaries between intonational phrases may be associated with breath sounds. Other text structure, such as sentence structure, paragraph structure, etc. may be considered when locating breath sounds. Breath sounds may also be located at other locations as indicated by the input text and the appropriate model(s). For example, the model(s) may indicate that while certain punctuation marks, such as periods, are typically followed by breaths, certain periods in the input text may not call for a breath mark due to various factors, such as the period following a short sentence may not call for its own breath in normal speech.

Breaths may be positioned based on the distance between the previous breath (known as the breath interval). The breath interval may be measured in a linguistic distance. The linguistic distance measures the distance between the breaths based on various factors including textual distance (such as the number of letters, words of text, etc. between breaths), phonetic distance (such as the number of spoken diphones, syllables, or other speech units between breaths), syntactical distance (such as the number of clauses, phrases, etc. in between breaths), in time (such as the estimated number of seconds of synthesized speech between breaths), or in some other measurement. If the TTS device is enabled to do so (such as through natural language processing capabilities or the like), it may also consider the semantic content of the speech between breaths and may locate breaths in appropriate locations based on the meaning of the speech. The TTS device may also determine breath intervals to have a certain default length and may endeavor to locate breaths during natural breaks in the speech output so as to create breath intervals that are as uniform as practical given the input text. Such uniformity of breath intervals may create a breathing rhythm that is pleasing to a listener. The TTS device may also choose to locate breaths to create breathing intervals which alter how the listeners perceives the speech output. For example, short breath intervals which result in multiple breaths over a short segment of speech may result in a listener being more excited while hearing the output speech whereas longer breath intervals may result in a calmer reading of the text.

If the TTS device is capable of doing so, it may also analyze the substantive content of the input text and place breaths to emphasize certain text, such as a particular word or text section. This may be referred to as the linguistic context of the breath. The linguistic context includes the context of the linguistic features of the neighboring area around the breath location. The linguistic features may include textual features (which considers the neighboring text and/or punctuation), phonetic features (which considers the neighboring phonemes or other speech units and/or how they will sound in output speech), syntactical features (which considers where the breath falls in terms of neighboring clauses, phrases, etc.), and/or semantic features (which may consider the meaning of the neighboring speech if the TTS device is so enabled. Other factors as indicated by the model(s) may also be considered when locating breaths in the output speech.

Once the location of a breath is determined, or as part of the same process that determines the breath locations, the TTS device determines what actual breath sounds should be placed in the determined locations. The process of locating and selecting breath sounds may also be iterative, where a TTS device determines a first set of potential breath locations and then attempts to identify breath units that fit well in the determined breath locations. If the TTS device determines that satisfactory breath units cannot be found for one or more breath locations (for example, for a particular breath location no breath units can be found that satisfy a cost function within a certain threshold), the TTS device may re-run the breath location determination while removing the previously identified breath location for which no satisfactory breath units are available. This process may iteratively continue until breath units are determined for each determined breath location. The location and selection processes may also be performed together, where the TTS device knows what breath units are available and determines the placement of specific breath units during the same process as identifying locations for breaths within the output speech.

The specific breath sounds chosen for particular locations may depend on a variety of factors. In one aspect, the breath sound may depend on the breath interval between the selected breath and the next breath, thus mimicking speaker breath capacity, which may be modeled by the TTS system based on the training corpus. As used here, breath capacity means the amount of speech that may be synthesized following a breath. The breath capacity may be based on the breath duration, or other factors and may impact the breath interval, and other factors. Breath capacity may be represented in words, syllables, time, or other measurement. Breath capacity may be modeled and tracked by a TTS system and may affect what breath sounds are inserted into text. For example, if a large amount of text happens between breaths, the TTS device may select a breath sound at the beginning of the text that sounds deeper and longer than if the text length were shorter, to simulate filling a speaker's lungs to a breath capacity. Similarly, if a large amount of text precedes the breath sound in question, the breath sound may be selected to be a faster breath sound to mimic a speaker catching his/her breath after a long segment of speech. Breath capacity may be used not only to determine breath locations and specific breath sounds, but may also affect how a TTS device synthesizes speech. For example, as a segment of speech approaches the end of a modeled breath capacity, the TTS system may increase the speed of output speech to simulate a speaker running out of breath. The output speech following such a breath may also be synthesized to mimic how a speaker resumes speech after catching his/her breath.

The breath sound may also depend on the breath's location in the text. Breath sounds after sentences may sound different than breath sounds between intonational phrases, which in turn sound different than breath sounds after paragraphs (which may be longer to indicate a longer break), and so on. Selected breath sounds (and breath locations) may also be based on the emotional tone of the input text, where certain breath sounds may excite or calm a listener, or otherwise contribute to the emotional or dramatic tone of the output speech. The breath sounds may also be based on the phonemes following or preceding the breath. The TTS device may select breath units and/or spoken units to match each other, thus selecting breath units with certain acoustic features that blend well with neighboring spoken units to reduce the breath units' join cost.

Breath sounds may be chosen to be uniform across a certain segment of speech in order to create a uniform effect to the listener. And in contrast, breath sounds may be chosen to be different from neighboring breath sounds in order to create an effect of breath variety for the listener.

Figure 6A:
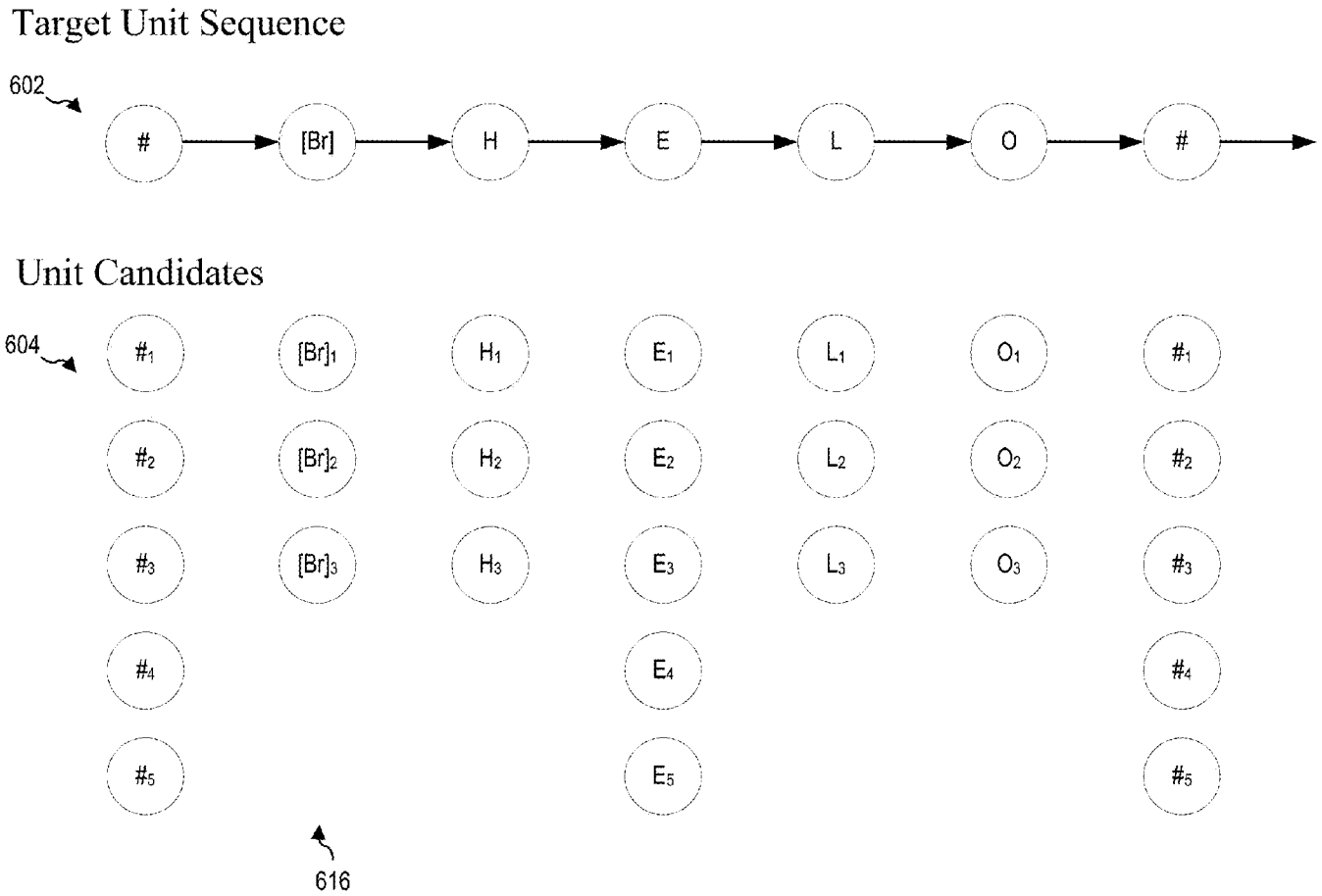
FIGS. 6A-6B illustrate speech synthesis using unit selection according to one aspect of the present disclosure.
Figure 6B:
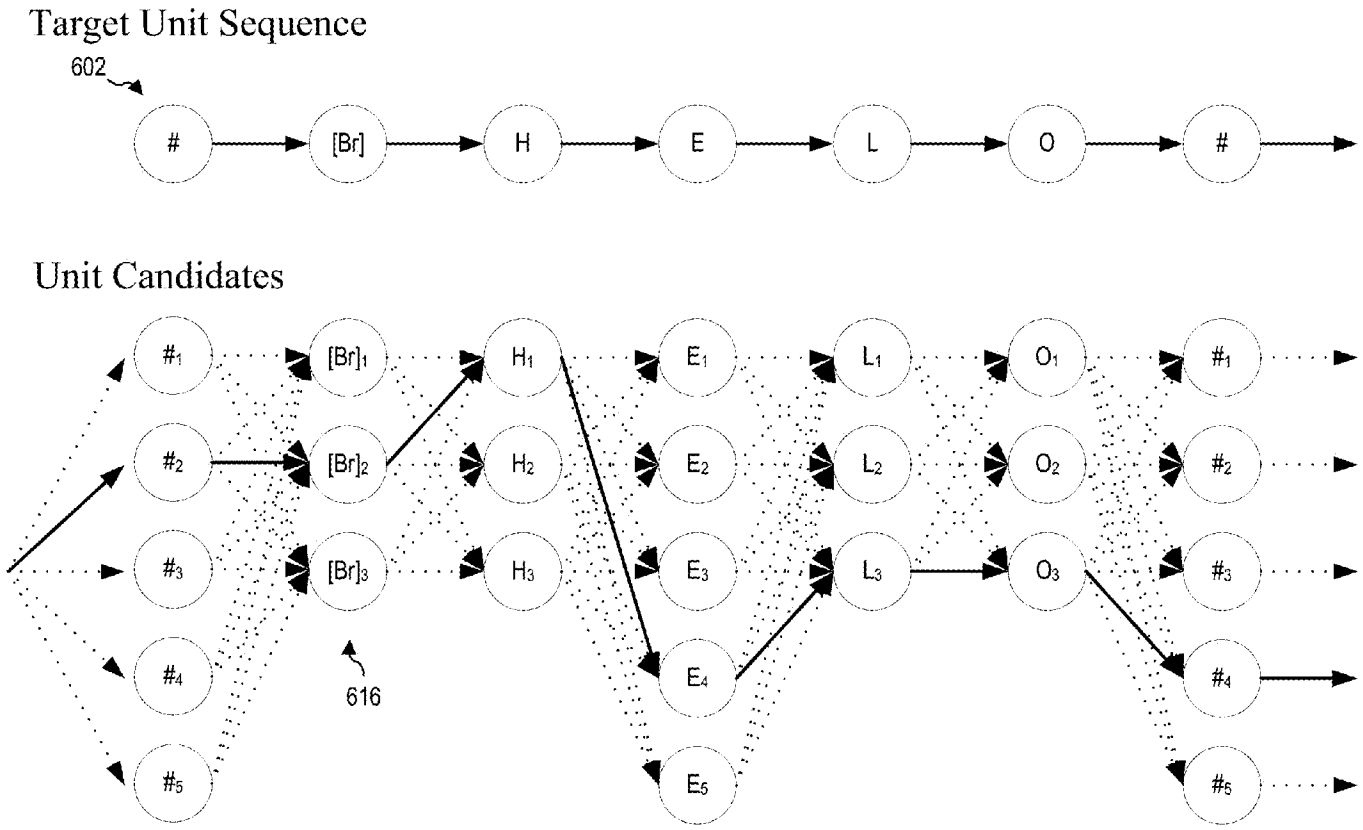

Breath sounds may be synthesized using unit selection or parametric synthesis. For unit selection, audio samples of different breath sounds are stored in a unit database and incorporated into the unit selection processing for synthesizing speech. A cost function will analyze the target cost and join cost of candidate breath units to determine which breath units should be included in the output speech. The cost function may consider any of the various factors considered above, or other factors which may impact the placement and selection of speech units. For example, FIG. 6A illustrates unit selection for the word "hello", as with FIG. 4A above, only the breath units, represented by the unit "[Br]", have been inserted into the target unit sequence 602. As illustrated the breath unit is located after the word break silence unit #, however the breath unit may be located before the silent unit in certain aspects. In another aspect the silence unit may be given a duration of zero when the breath units are included. As shown in FIG. 6A, the unit candidates now also include a series of candidate breath units 616 which include units $[Br]_1$, $[Br]_2$, and $[Br]_3$. Although only three breath units are illustrated, many more may be available in an implemented system. The unit selection processing, including the cost function, will consider the available breath units for selection and synthesis. As illustrated in FIG. 6B, the units $\#_2$, $[Br]_2$, $H_1$, $E_4$, $L_3$, $O_3$, and $\#_4$ may be selected to synthesize audio for the word "hello" with a preceding breath.

In one aspect the TTS system may blend a breath sound with a voiced sound to further revise the speech to mimic when a human speaks while breathing. In such situations the TTS device may be trained to recognize appropriate phonetic units and/or breath context where blending is to be performed. For such situations, a boundary between breath and voiced phoneme (or other phonetic unit) will be less clear and the sound of the breath and phoneme will be output together for a period of time to mimic a speaker's voiced breath. In one aspect the blending of a phoneme and breath may be determined as part of determining a location of a breath, in another aspect determining when to blend a voiced phoneme with a breath may be determined as a separate process. In one aspect the breath sound and neighboring phone (or other speech unit) may be blended using coarticulation. Coarticulation may influence both the breath sound and neighboring phone applying some features of each unit to the neighboring unit to create the blended sound. Thus each unit may be slightly altered in order to blend the units together to create the slightly overlapping sound of the breath unit and neighboring phone.

Figure 7:
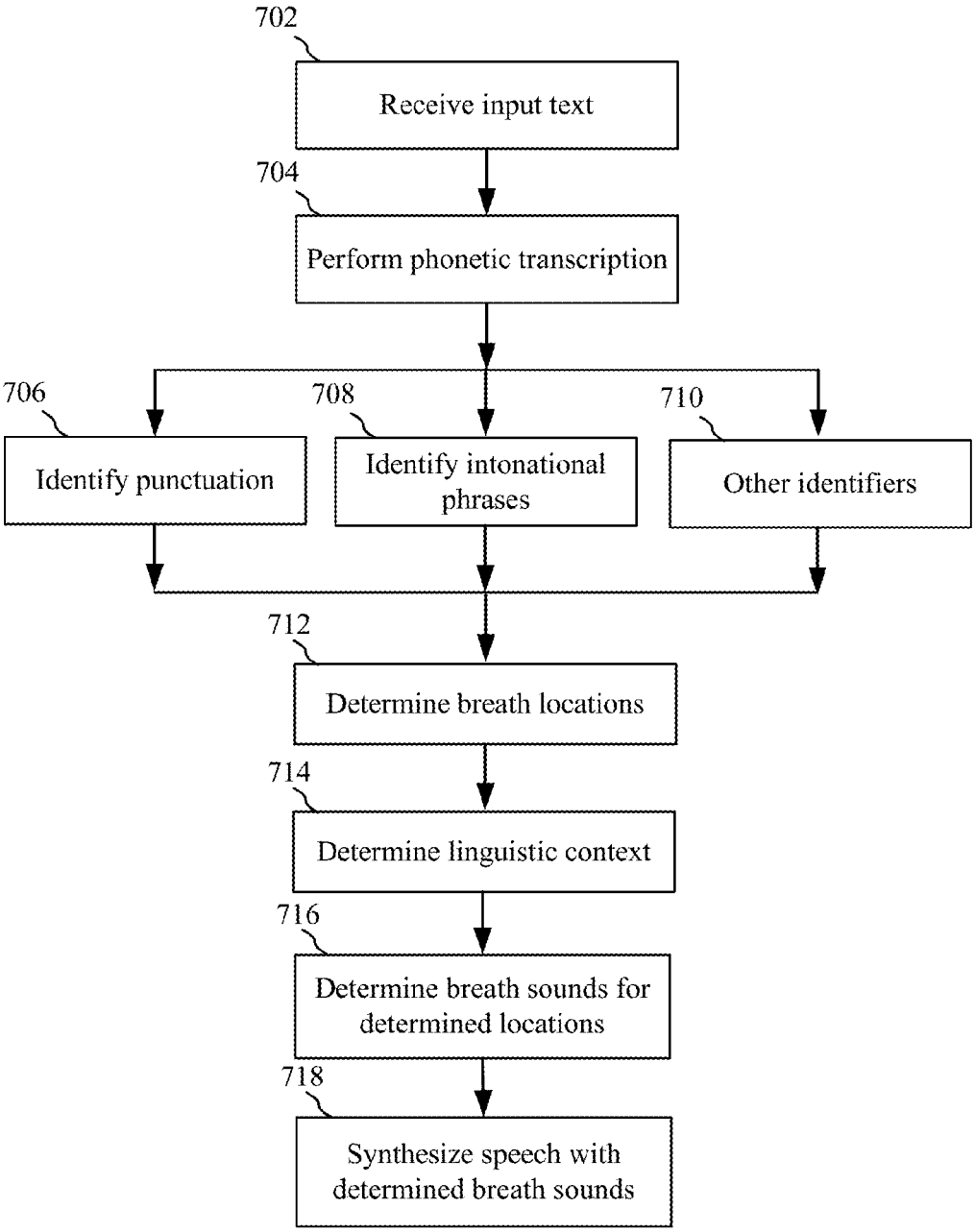
FIG. 7 illustrates generating speech with breath sounds according to one aspect of the present disclosure.

FIG. 7 illustrates performing TTS processing to include breath sounds according to one aspect of the present disclosure. Various steps are illustrated that may be performed together, separately, or in a different order than shown in FIG. 7. A TTS device may receive input text, as shown in block 702. The TTS device may then analyze the input text and perform phonetic transcription, as shown in block 704. The TTS device may then identify punctuation (706), identify intonational phrases (708), or perform other identification procedures on the text (710) to determine the location of breath sounds (712) to be inserted into the ultimate output speech. The TTS device may then determine the linguistic context of the individual locations, as shown in block 714. Based on the linguistic context, the linguistic distance, and/or other factors, the TTS device may determine what breath sounds should be inserted into the determined locations, as shown in block 716. For unit selection, the TTS device may determine the breath sounds based on a cost function of the available breath units. For parametric synthesis, the acoustic features of breath sounds may be stored as parameters to be reproduced by the vocoder as part of the speech output. A parametric synthesis engine 232 may coordinate with a breath insertion module 222 to determine the appropriate parameters for breath sounds in particular locations. A statistical model may be developed to determine and synthesize breath sounds according to trained (at training) and determined (at runtime) acoustic parameters for appropriate breath sounds. The TTS device may then synthesize speech using the located and determined breath sounds, as described above and as shown in block 718.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. For example, the TTS techniques described herein may be applied to many different languages, based on the language information stored in the TTS storage.

Aspects of the present disclosure may be implemented as a computer implemented method, a system, or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid state memory, flash drive, removable disk, and/or other media.

Aspects of the present disclosure may be performed in different forms of software, firmware, and/or hardware. Further, the teachings of the disclosure may be performed by an application specific integrated circuit (ASIC), field programmable gate array (FPGA), or other component, for example.

Aspects of the present disclosure may be performed on a single device or may be performed on multiple devices. For example, program modules including one or more components described herein may be located in different devices and may each perform one or more aspects of the present disclosure. As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method of generating speech including audible breath sounds, the method comprising:

receiving input text for text-to-speech (TTS) processing;

identifying punctuation in the input text;

determining a first location in the input text for insertion of a breath sound based at least in part on the punctuation;

determining a second location in the input text for insertion of a breath sound based at least in part on the punctuation;

determining a linguistic distance between the first location and second location;

using a cost function to identify a first breath unit for the first location, the cost function based at least in part on the identified punctuation, the linguistic distance between the first location and second location, and a linguistic context of the first location;

using the cost function to identify a second breath unit for the second location, the cost function based at least in part on the identified punctuation, the linguistic distance between the first location and second location, and a linguistic context of the second location; and synthesizing speech corresponding to the input text, wherein the synthesized speech comprises a first breath sound corresponding to the first breath unit at the first location and a second breath sound corresponding to the second breath unit at the second location.

2. The computer-implemented method of claim 1, further comprising identifying an intonational phrase in the input text, wherein:

the first location occurs at a beginning of the intontational phrase;

the second location occurs at an end of the intonational phrase;

using the cost function to identify the first breath unit is further based at least in part on linguistic features of the intonational phrase; and using the cost function to identify the second breath unit is further based at least in part on the linguistic features of the intonational phrase.

3. The computer-implemented method of claim 1, further comprising determining a rate of speech based at least in part on a duration of the first breath sound, and wherein synthesizing the speech is based at least in part on the determined rate of speech.

4. A computing system, comprising:

at least one processor;

a memory device including instructions operable to be executed by the at least one processor to perform a set of actions, configuring the at least one processor:

to receive input text;

to identify a location in the input text for a breath;

to identify a duration for the breath in the location;

to determine a breath sound for the location, the breath sound determined from a plurality of breath sounds; and to synthesize speech corresponding to the input text using the duration and data corresponding to the breath sound, the synthesized speech comprising the breath sound at substantially the location.

5. The computing system of claim 4, wherein the at least one processor is further configured to identify punctuation in the input text, wherein the instructions further comprise instructions to configure the at least one processor to identify the location based at least in part on the identified punctuation.

6. The computing system of claim 4, wherein the instructions further comprise instructions to configure the at least one processor to identify an intonational phrase in the input text, wherein the at least one processor is configured to identify the location based at least in part on the intonational phrase.

7. The computing system of claim 4, wherein the plurality of breath sounds are represented by a plurality of parametric models of breath sounds and wherein the instructions further comprise instructions to configure the at least one processor to synthesize the breath sound using a vocoder.

8. The computing system of claim 4, wherein the plurality of breath sounds are represented by a plurality of pre-recorded breath sounds and wherein the instructions further comprise instructions to configure the at least one processor to synthesize the breath sound using unit selection of the plurality of pre-recorded breath sounds.

9. The computing system of claim 4, wherein the instructions further comprise instructions to configure the at least one processor to identify a second location in the input text for a second breath, and wherein the synthesized speech comprises a second breath sound at the second location.

10. The computing system of claim 9, wherein the instructions further comprise instructions to configure the at least one processor to determine a distance between the identified location and second location, and wherein the breath sound is based at least in part on the distance.

11. The computing system of claim 9, wherein the instructions further comprise instructions to configure the at least one processor to determine a distance between the identified location and second location, and wherein the second breath sound is based at least in part on the distance.

12. The computing system of claim 9, wherein the second location is based at least in part on a duration of the breath sound.

13. The computing system of claim 4, wherein the synthesized speech comprises spoken speech that overlaps at least a portion of the breath sound.

14. A non-transitory computer-readable storage medium storing processor-executable instructions for controlling a computing device, comprising:

program code to receive input text;

program code to identify a location in the input text for a breath;

program code to identify a duration for the breath in the location;

program code to determine a breath sound for the location, the breath sound determined from a plurality of breath sounds; and program code to synthesize speech corresponding to the input text using the duration and data corresponding to the breath sound, the synthesized speech comprising the breath sound at substantially the location.

15. The non-transitory computer-readable storage medium of claim 14, further comprising program code to identify punctuation in the input text, wherein the program code to identify the location is based at least in part on the identified punctuation.

16. The non-transitory computer-readable storage medium of claim 14, further comprising program code to identify an intonational phrase in the input text, wherein the program code to identify the location is based at least in part on the intonational phrase.

17. The non-transitory computer-readable storage medium of claim 14, wherein the plurality of breath sounds are represented by a plurality of parametric models of breath sounds and wherein the non-transitory computer-readable storage medium further comprises program code to synthesize the breath sound using a vocoder.

18. The non-transitory computer-readable storage medium of claim 14, wherein the plurality of breath sounds are represented by a plurality of pre-recorded breath sounds and wherein the non-transitory computer-readable storage medium further comprises program code to synthesize the breath sound using unit selection of the plurality of pre-recorded breath sounds.

19. The non-transitory computer-readable storage medium of claim 14, further comprising program code to identify a second location in the input text for a second breath, and wherein the synthesized speech comprises a second breath sound at the second location.

20. The non-transitory computer-readable storage medium of claim 19, further comprising program code to determine a distance between the identified location and second location, and wherein the breath sound is based at least in part on the distance.

21. The non-transitory computer-readable storage medium of claim 19, further comprising program code to determine a distance between the identified location and second location, and wherein the second breath sound is based at least in part on the distance.

22. The non-transitory computer-readable storage medium of claim 19, wherein the second location is based at least in part on a duration of the breath sound.

23. The non-transitory computer-readable storage medium of claim 14, wherein the synthesized speech comprises spoken speech that overlaps at least a portion of the breath sound.

* * * * *